US007725066B2

(12) United States Patent
Kagawa

(10) Patent No.: US 7,725,066 B2
(45) Date of Patent: May 25, 2010

(54) FIXING ROLLER AND IMAGE FORMING APPARATUS

(75) Inventor: Toshiaki Kagawa, Kitakatsuragi-gun Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 135 days.

(21) Appl. No.: 12/021,437

(22) Filed: Jan. 29, 2008

(65) Prior Publication Data

US 2008/0187374 A1 Aug. 7, 2008

(30) Foreign Application Priority Data

Feb. 2, 2007 (JP) ..... 2007-024786

(51) Int. Cl.

| | |
|---|---|
| ***G03G 15/16*** | (2006.01) |
| ***G03G 15/20*** | (2006.01) |
| ***G03G 15/08*** | (2006.01) |
| ***G03G 15/00*** | (2006.01) |

(52) U.S. Cl. ..... 399/333; 399/122; 399/279; 399/320; 399/400

(58) Field of Classification Search ..... 399/122, 399/176, 239, 279, 313, 320, 333, 400
See application file for complete search history.

(56) References Cited

U.S. PATENT DOCUMENTS

| | | | | |
|---|---|---|---|---|
| 3,686,731 | A * | 8/1972 | Koori et al. | 492/56 |
| 4,719,130 | A * | 1/1988 | Shimizu et al. | 427/380 |
| 4,844,953 | A * | 7/1989 | Kato et al. | 427/387 |
| 5,217,532 | A | 6/1993 | Sasame et al. | |
| 5,684,065 | A * | 11/1997 | Hiraoka et al. | 523/300 |
| 6,020,038 | A * | 2/2000 | Chen et al. | 428/36.9 |
| 6,272,309 | B1 * | 8/2001 | Kitazawa et al. | 399/333 |
| 6,400,924 | B1 * | 6/2002 | Watanabe | 399/333 |
| 6,761,673 | B2 * | 7/2004 | Shudo | 492/56 |
| 6,908,419 | B2 * | 6/2005 | Takashima et al. | 492/56 |
| 7,392,010 | B2 * | 6/2008 | Shibuya | 399/390 |
| 7,494,706 | B2 * | 2/2009 | Chen et al. | 428/339 |
| 2005/0111892 | A1 | 5/2005 | Mitsuoka et al. | |
| 2007/0298252 | A1 * | 12/2007 | Chen et al. | 428/339 |

FOREIGN PATENT DOCUMENTS

| | | |
|---|---|---|
| JP | H1-147578 | 6/1989 |
| JP | 10-298316 | 11/1998 |
| JP | 2001-312169 | 11/2001 |
| JP | 2005-156826 | 6/2005 |

* cited by examiner

*Primary Examiner*—David M Gray
*Assistant Examiner*—Francis Gray
(74) *Attorney, Agent, or Firm*—Renner, Otto, Boisselle & Sklar, LLP

(57) ABSTRACT

A fixing roller includes: a core; an elastic layer made of an elastic material, formed around the core; and a resin layer made of fluorine resin, formed around the elastic layer. The fixing roller is designed such that the resin layer has a thickness of 40 μm or more, and the fixing roller meets a relation Tr≧Tc+60 or Tr≧Tc+75 where Tr (° C.) is a limit temperature obtained in a predetermined peeling test and Tc (° C.) is a temperature of the fixing roller at which a fixing process is performed. This allows the fixing roller used in an image forming apparatus with a high process speed to secure that the resin layer is less likely to be detached from the elastic layer.

22 Claims, 4 Drawing Sheets

FIXING ROLLER AND IMAGE FORMING APPARATUS

This non-provisional application claims priority under 35 U.S.C. §119(a) on Patent Application No. 2007-024786 filed in Japan on Feb. 2, 2007, the entire contents of which are hereby incorporated by reference.

FIELD OF THE INVENTION

The present invention relates to a fixing roller that is a component of a fixing apparatus included in an electrophotographic image forming apparatus.

BACKGROUND OF THE INVENTION

In general, a fixing roller used in an electrophotographic image forming apparatus (e.g. a copying machine, a multifunctional apparatus, and a printer), particularly a fixing roller used in a color printer, includes a structure in which an elastic layer made of silicone rubber is formed around a metal core and a resin layer (surface layer) made of a PFA tube is provided around the elastic layer.

The fixing roller coated with the PFA tube is produced in such a manner that a PFA tube whose internal surface has been subjected to an etching treatment and to application of primer is fixed to the inside of a cylindrical mold, a core is inserted into the PFA tube, and then silicone rubber is poured into a space between the core and the PFA tube, and the silicone rubber is heated and cured, so that the PFA tube and the silicone rubber are molded integrally.

Further, in the fixing roller, a PFA tube with a thickness of 30 μm is generally used in order that elasticity of silicone rubber is impaired as little as possible, a wider nip width and a higher detachability of a sheet are secured, and unevenness in luster does not appear.

[Patent Document 1]

Japanese Unexamined Patent Publication No. 2001-312169 (Tokukai 2001-312169; published on Nov. 9, 2001)

However, the above fixing roller has inconvenience. When the fixing roller is used in a high-speed printer whose process speed (peripheral velocity of the fixing roller) is 300 mm/s or more, mechanical and thermal stress applied on the PFA tube is large, resulting in occurrence of wrinkles on the PFA tube.

An effective way to prevent such wrinkles is to make the PFA tube thicker (e.g. 40 μm or more), thereby increasing mechanical strength of the PFA tube. However, as a result of a test, the inventors of the present invention found that as the PFA tube becomes thicker, the PFA tube (resin layer) is more likely to be detached from the silicone rubber (elastic layer) at their interface. The reason is as follows: making the PFA tube thicker reduces flexibility of the PFA tube, and accordingly the PFA tube cannot sufficiently follow deformation of the silicone rubber, resulting in occurrence of shearing stress between the PFA tube and the silicone rubber.

In particular, in a case where the thickness of the silicone rubber (the thickness of the elastic layer) is large and/or hardness of the silicone rubber is low, deformation (shearing stress) of the elastic layer made of the silicone rubber gets large, which exhibits the above problem.

In order to solve the above problem, paragraph [0020] of Patent Document 1 discloses a method for adhereing a PFA tube, including steps (1) to (4) as follows: (1) a rubber roller made of silicone rubber is coated with a PFA tube, (2) an adhesive made of silicone rubber with self-adhesiveness is poured between the rubber roller and the PFA tube, (3) the PFA tube is squeezed by an O-ring so that the poured adhesive spreads from one end of the PFA tube to the other end of the PFA tube, and (4) the adhesive is heated and cured so that the PFA tube is adhered to the rubber roller. However, this method requires a far more complex manufacture process compared with a conventional manufacture method and has a difficulty in evenly forming an adhesive layer with a predetermined thickness, resulting in problems in quality and cost up.

For that reason, there is a request for a fixing roller that is different from the fixing roller disclosed in Patent Document 1 and that can prevent the above problem (the problem such that the elastic layer made of silicone rubber is likely to be detached from the resin layer made of the PFA tube).

SUMMARY OF THE INVENTION

An object of the present invention is to provide a fixing roller which is used in an image forming apparatus with a high process speed (300 mm/s or more) and in which a resin layer is less likely to be detached from an elastic layer even when the resin layer is thick (40 μm or more).

In order to solve the foregoing problems, a fixing roller of the present invention is a fixing roller that is included in a fixing apparatus of an image forming apparatus and that includes: a core; an elastic layer made of an elastic material, formed around the core; and a resin layer made of fluorine resin, formed around the elastic layer, the resin layer having a thickness of 40 μm or more, a peripheral velocity of the fixing roller being set to be 300 mm/s or more in the fixing apparatus, the fixing roller meeting a relation $Tr \geqq Tc+60$ where Tr (° C.) is a limit temperature obtained in a detachment test and Tc (° C.) is a temperature of the fixing roller at which the fixing apparatus performs a fixing process, the detachment test being performed in such a manner that a part of the fixing roller that includes the elastic layer and the resin layer is cut out as a sample, the sample is heated in contact with a heating material with a temperature X (° C.) while being subjected to application of a load, and it is confirmed whether or not the resin layer is detached from the elastic layer in the sample after the heating, the detachment test being performed plural times with different temperatures X (° C.), a detachment test with a highest temperature X (° C.) being selected out of one or more detachment tests in which detachment between the resin layer and the elastic layer is not observed, and the temperature X (° C.) of the selected detachment test being regarded as the limit temperature.

With the fixing roller that meets the relation $Tr \geqq Tc+60$, when the resin layer has a thickness of 40 μm or more and the fixing roller is used in an image forming apparatus in which a peripheral velocity of a fixing roller is set to 300 mm/s or more, the resin layer is less likely to be detached (detached at its interface) from the elastic layer.

In order to solve the foregoing problems, a fixing roller of the present invention is a fixing roller that is included in a fixing apparatus of an image forming apparatus and that includes: a core; an elastic layer made of an elastic material, formed around the core; and a resin layer made of fluorine resin, formed around the elastic layer, the resin layer having a thickness of 40 μm or more, a peripheral velocity of the fixing roller being set to be 355 mm/s or more in the fixing apparatus, the fixing roller meeting a relation $Tr \geqq Tc+75$ where Tr (° C.) is a limit temperature obtained in a detachment test and Tc (° C.) is a temperature of the fixing roller at which the fixing apparatus performs a fixing process, the detachment test being performed in such a manner that a part of the fixing roller that includes the elastic layer and the resin layer is cut out as a sample, the sample is heated in contact with a heating material with a temperature X (° C.) while being subjected to application of a load, and it is confirmed whether or not the resin layer is detached from the elastic layer in the sample after the heating, the detachment test being performed plural times with different temperatures X (° C.), a detachment test with a highest temperature X (° C.) being selected out of one or more detachment tests in which detachment between the resin layer and the elastic layer is not observed, and the temperature X (° C.) of the selected detachment test being regarded as the limit temperature.

With the fixing roller that meets the relation Tr≧Tc+75, when the resin layer has a thickness of 40 m or more and the fixing roller is used in an image forming apparatus in which a peripheral velocity of a fixing roller is set to 355 mm/s or more, the resin layer is less likely to be detached (detached at its interface) from the elastic layer.

For a fuller understanding of the nature and advantages of the invention, reference should be made to the ensuing detailed description taken in conjunction with the accompanying drawings.

DESCRIPTION OF THE EMBODIMENTS

A fixing roller of an embodiment of the present invention satisfies a relation of Tr≧Tc+60 or Tr≧Tc+75 where Tr (C.°) is a limit detachment temperature which will be mentioned later and Tc (C.°) is a temperature of the fixing roller at a time of a fixing process.

The inventors of the present invention made various tests to find the relation. The following firstly explains a structure of a fixing roller for the tests and a manufacture method of the fixing roller, and then explains the tests in detail.

Figure 1:
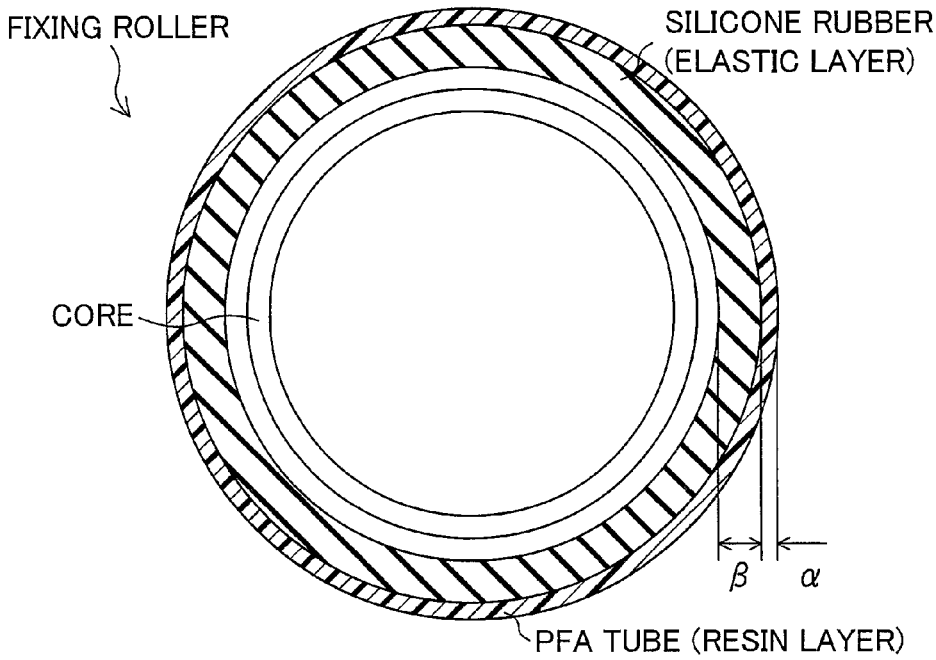
FIG. 1 is a cross sectional drawing illustrating a fixing roller.

FIG. 1 is a cross sectional drawing illustrating the fixing roller for the tests. As illustrated in FIG. 1, the fixing roller includes: a metal core; an elastic layer that is made of silicone rubber (elastic material) and that is formed around the core; and a resin layer (surface layer) that is made of a PFA tube (fluorine resin) and that is formed around the elastic layer. The specification of the fixing roller is detailed as follows.

<Specification of Fixing Roller>

Diameter of roller: 50 mm

PFA tube: nonconductive and thermally contractive (both in a peripheral direction and an axis direction) type Thickness of PFA tube: 50 μm Treatment of internal surface of PFA tube: etching treatment in which liquid ammonia containing dissolved metallic sodium is used as a treatment solution.

Thickness of silicone rubber: 2 mm

Hardness of silicone rubber: 20 degrees (ASKER-C hardness)

Thermal conductivity of silicone rubber: 0.45 W/(m·C.°)

Core: aluminum

Diameter of core: 35.9 mm

Radial thickness of core: 3 mm

The thickness of the PFA tube corresponds to the thickness (radial thickness) of the resin layer of the fixing roller, and corresponds to the length of a reference sign a in FIG. 1. Further, the thickness of the silicone rubber corresponds to the thickness of the elastic layer of the fixing roller, and corresponds to the length of a reference sign β in FIG. 1.

The method of manufacturing a fixing roller coated with the PFA tube is as follows.

<Method of Manufacturing Fixing Roller>

(1) A PFA tube whose internal surface has been subjected to an etching treatment is fixed to the inside of a cylindrical mold.

(2) Primer is applied on the internal surface of the PFA tube with an application jig.

(3) A core is inserted into the PFA tube fixed to the inside of the cylindrical mold.

(4) Silicone rubber is poured into a space between the core and the PFA tube.

(5) The cylindrical mold is heated in order to heat and cure the silicone rubber (first vulcanization).

(6) A fixing roller consisting of the core, the silicone rubber, and the PFA tube is taken out from the cylindrical mold.

(7) The fixing roller thus taken out is put into a batch type furnace and is heated (second vulcanization).

In the present embodiment, in order to examine properties of the fixing roller manufactured as described above, the fixing roller was actually mounted on a conventional middle-speed color multifunctional apparatus and on a high-speed color multifunctional apparatus, and a first printing aging test (10 fixing rollers were evaluated) was performed.

The first printing aging test was a test in which printing was continuously performed in a multifunctional apparatus and then the life (duration of life) of a fixing roller mounted on the multifunctional apparatus was measured. The life was represented by the number of printing performed before the PFA tube was detached from the silicone rubber in the fixing roller.

The middle-speed color multifunctional apparatus (hereinafter referred to as "middle-speed apparatus") was MX-4500N manufactured by Sharp Corporation. Its spec was such that a process speed (also referred to as peripheral velocity of fixing roller, sheet transfer speed, or fixing speed) was 225 mm/s and a printing speed was 45 sheets/minute. The high-speed color multifunctional apparatus (hereinafter referred to as "high-speed apparatus") was a test model manufactured by Sharp Corporation. Its spec was such that a process speed was 300 mm/s and a printing speed was 62 sheets/minute.

Table 1 shows the result of the first printing aging test. In Table 1, N1 to N10 and M1 to M10 are identification signs for fixing rollers to be evaluated.

TABLE 1

| EVALUATED APPARATUS | PROCESS SPEED | PRINTING SPEED | LIFE OF FIXING ROLLER (TEN THOUSAND SHEETS) | | | | | | | | | | AVERAGE (TEN THOUSAND SHEETS) | STANDARD DEVIATION (TEN THOUSAND SHEETS) |
|---|---|---|---|---|---|---|---|---|---|---|---|---|---|---|
| MIDDLE SPEED APPARATUS | 225 mm/s | 45 sheet/min | N1 | N2 | N3 | N4 | N5 | N6 | N7 | N8 | N9 | N10 | 35 | 6.0 |
| | | | 27 | 35 | 42 | 30 | 25 | 45 | 32 | 38 | 36 | 35 | | |
| HIGH SPEED APPARATUS | 300 mm/s | 62 sheet/min | M1 | M2 | M3 | M4 | M5 | M6 | M7 | M8 | M9 | M10 | 30 | 8.1 |
| | | | 38 | 33 | 33.5 | 14 | 32 | 42 | 28 | 18.6 | 35 | 26 | | |

As shown in Table 1, in a case where the fixing rollers were mounted on the middle-speed apparatus, all of the ten fixing rollers attained the target life of two hundred thousand sheets. However, in a case where the fixing rollers were mounted on the high-speed apparatus, two of the ten fixing rollers did not attain the target life of two hundred thousand sheets. The two fixing rollers did not attain the target life because the PFA tube was detached from the silicone rubber.

Accordingly, the inventors of the present invention examined the reason why in some cases the PFA tube of the fixing roller was detached from the silicone rubber when the filing roller was mounted on the high-speed apparatus. The result of the examination is detailed below.

The PFA tube is less likely to deform compared with silicone rubber (the PFA tube is less flexible than silicone rubber). Consequently, the PFA tube cannot sufficiently follow the deformation of the silicone rubber that occurs in the vicinity of a fixing nip area (see FIG. 5), resulting in mechanical stress (shearing stress) at an interface between the PFA tube and the silicone rubber in the fixing roller. As the process speed (i.e. peripheral velocity of the fixing roller) is higher, the mechanical stress is larger. Accordingly, as the process speed is higher, the PFA tube is more likely to be detached from the silicone rubber at their interface. Further, as the process speed is higher, a time for heating a sheet at the fixing nip area gets shorter, resulting in shortage of the amount of heat. In order to compensate the shortage, it is required to set a fixing temperature to be higher. This enlarges a thermal stress at the interface between the PFT tube and the silicone rubber, which makes the PFA tube more likely to be detached form the silicone rubber. The fixing temperature is a temperature of the fixing roller at a time when a fixing process is performed in a fixing apparatus, and is a temperature of the fixing roller at a time when a sheet touches a peripheral surface of the fixing roller.

As shown in Table 1, the result of the first printing aging test showed that the fixing rollers used in the test had great unevenness in their lives. The inventors of the present invention thought that such great unevenness was due to unevenness in adhesive strength of the PFA tube (resin layer) with respect to the silicone rubber (elastic layer) at a time of manufacture. Accordingly, the inventors of the present invention thought that reducing the unevenness would make the lives of the fixing rollers longer and substantially even.

Thus, the inventors of the present invention thought that six manufacture conditions shown in Table 2 were causes for unevenness in adhesive strength of the PFA tube with respect to the silicone rubber, and examined a relation between the manufacture conditions and the adhesive strength.

TABLE 2

| | MANUFACTURE CONDITIONS | | | | | | PEELING TEST | | |
|---|---|---|---|---|---|---|---|---|---|
| | TIME FOR ETCHING TREATMENT OF INTERNAL SURFACE OF PFA TUBE | FIRST-VULCANIZATION TEMPERATURE | SECOND VULCANIZATION TIME | SECOND VULCANIZATION TEMPERATURE | TIME FOR DRYING PRIMER | AMOUNT OF APPLIED PRIMER | 250° C. | 265° C. | 280° C. |
| FIXING ROLLER a | STANDARD | STANDARD | STANDARD (1) | STANDARD | STANDARD | STANDARD (1) | ○ | ○ | X |
| FIXING ROLLER b | SHORT | STANDARD | STANDARD (1) | STANDARD | STANDARD | STANDARD (1) | ○ | ○ | X |
| FIXING ROLLER c | STANDARD | LOW | STANDARD (1) | STANDARD | STANDARD | STANDARD (1) | ○ | ○ | X |
| FIXING ROLLER d | STANDARD | HIGH | STANDARD (1) | STANDARD | STANDARD | STANDARD (1) | ○ | ○ | X |
| FIXING ROLLER e | STANDARD | STANDARD | SHORT (0.5) | STANDARD | STANDARD | STANDARD (1) | ○ | ○ | X |
| FIXING ROLLER f | STANDARD | STANDARD | LONG (2) | STANDARD | STANDARD | STANDARD (1) | ○ | ○ | X |
| FIXING ROLLER g | STANDARD | STANDARD | STANDARD (1) | WITHOUT SECOND VULCANIZATION | STANDARD | STANDARD (1) | ○ | ○ | X |
| FIXING ROLLER h | STANDARD | STANDARD | STANDARD (1) | LOW (−20° C.) | STANDARD | STANDARD (1) | ○ | ○ | X |
| FIXING ROLLER i | STANDARD | STANDARD | STANDARD (1) | STANDARD | LONG | STANDARD (1) | ○ | ○ | X |

TABLE 2-continued

| | MANUFACTURE CONDITIONS | | | | | | PEELING TEST | | |
|---|---|---|---|---|---|---|---|---|---|
| | TIME FOR ETCHING TREATMENT OF INTERNAL SURFACE OF PFA TUBE | FIRST-VULCANI-ZATION TEM-PERATURE | SECOND VULCANI-ZATION TIME | SECOND VULCANI-ZATION TEM-PERATURE | TIME FOR DRYING PRIMER | AMOUNT OF APPLIED PRIMER | 250° C. | 265° C. | 280° C. |
| FIXING ROLLER j | STANDARD | STANDARD | STANDARD (1) | STANDARD | STANDARD | MUCH (3.7) | X | X | X |
| FIXING ROLLER k | STANDARD | STANDARD | STANDARD | STANDARD | STANDARD | MUCH (3.3) | Δ | X | X |
| FIXING ROLLER l | STANDARD | STANDARD | STANDARD | STANDARD | STANDARD | STANDARD (1.4) | ○ | ○ | X |
| FIXING ROLLER m | STANDARD | STANDARD | STANDARD | STANDARD | STANDARD | LITTLE (0.6) | ○ | ○ | Δ |
| FIXING ROLLER n | STANDARD | STANDARD | STANDARD | STANDARD | STANDARD | LITTLE (0.2) | ○ | ○ | Δ |

More specifically, the inventors of the present invention manufactured 14 fixing rollers (fixing rollers a to n shown in Table 2) with each of the six manufacture conditions being parameter and other manufacture conditions and specifications being the same as those for the fixing rollers shown in Table 1. Each of the fixing rollers a to n was subjected to a peeling test (hot plate test, detachment test) devised by the inventors, and adhesive strength of the PFA tube with respect to the silicone rubber was evaluated. The result of the peeling test is shown in Table 2.

In Table 2, evaluations such as "standard", "high", "low", "long", "short" etc. are relative evaluations in a case where the manufacture conditions of the fixing roller a were regarded as standards. For example, time for drying primer of the fixing roller b is "standard", which indicates that the time for drying primer of the fixing roller b is the same as that of the fixing roller a. First vulcanization temperature of the fixing roller c is "low", which indicates that the first vulcanization temperature of the fixing roller c is lower than that of the fixing roller a.

In columns for second vulcanization time and the amount of applied primer shown in Table 2, numerals are shown in parentheses. The numerals represent ratios of values of each fixing roller to values of the fixing roller a. For example, 3.7 is written in the column for the amount of applied primer of the fixing roller j, which indicates that the amount of applied primer of the fixing roller j is 3.7 times larger than that of the fixing roller a.

−20° C. is written in the column for the second vulcanization temperature of the fixing roller h, which indicates that the second vulcanization temperature of the fixing roller h is lower by 20° C. than that of the fixing roller a.

Figure 2:
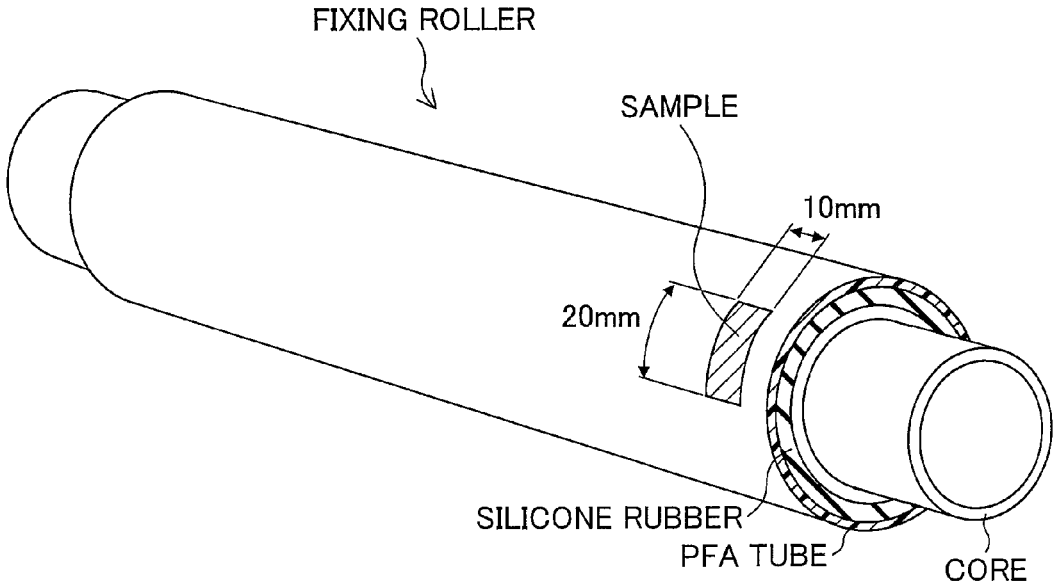
FIG. 2 is an oblique drawing illustrating the fixing roller in FIG. 1.
Figure 3:
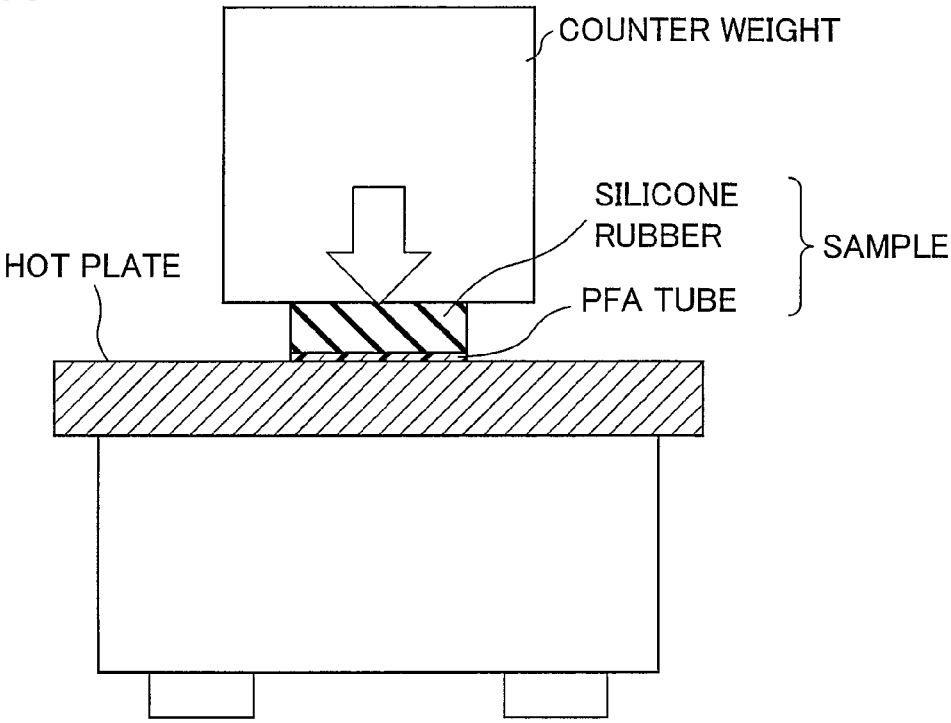
FIG. 3 is a side drawing illustrating test equipment used in a peeling test.

Prior to the examination of the result of Table 2, the following makes a detailed explanation as to a procedure of the peeling test with reference to FIGS. 2 and 3, and then makes a detailed explanation as to a method of measuring the amount of applied primer shown in Table 2.

<Procedure of Peeling Test>

(1) A layer including the elastic layer (silicone rubber) and the resin layer (PFA tube) is regarded as a coating layer. As illustrated in FIGS. 2 and 3, a part of the coating layer is cut out so that the part has a rectangular shape with a width of 10 mm and a length of 20 mm and that the part is cut out along the core, and the coating layer thus cut out is treated as a sample for the test. The elastic layer (silicone rubber) may have a thickness of approximately 1 mm.

(2) As illustrated in FIG. 3, the cut out sample is placed on a hot plate (here, ND-1 manufactured by AS ONE Corporation) that is set so that the heating surface has a temperature X (° C.). The sample is placed on the hot plate so that the PFA tube of the sample (front layer of the sample) contacts the heating surface (heater) of the hot plate.

(3) As illustrated in FIG. 3, a counter weight corresponding to 9.8 N (1 kgf) of a strength (weight) is placed on the sample, and thus a load is applied on the sample. The counter weight is made of metal (aluminum in the present embodiment) and has a square pole shape with 50 mm in height, 50 mm in width, and 50 mm in depth.

(4) The sample is heated for 5 hours while the load is applied on the sample and the sample is in contact with the heating surface with the temperature X (° C.).

(5) It is confirmed whether the PFA tube is detached from the silicone rubber in the sample having been heated for 5 hours. The confirmation is made by a trier lightly pulling the PFA tube with hands to confirm whether the PFA tube is detached from the silicone rubber or not. After the confirmation, adhesive strength of the PFA tube with respect to the silicone rubber is evaluated based on the following indices.

(Indices)

○: A sample in which the PFA tube was not detached from the silicone rubber at their interface (breakage of the silicone rubber occurred)

Δ: A sample in which the PFA tube was detached from the silicone rubber at a part of their adherend X: A sample in which the PFA tube was detached from the silicone rubber at a whole part of their adherend -: A sample that was not evaluated In the present embodiment, a plurality of peeling tests were performed with respect to each of the fixing rollers to be evaluated (note that, the temperature X (° C.) of the heating surface of the hot plate was changed with respect to each test). Specifically, three samples a, b, and c were cut out from each fixing roller to be evaluated. Adhesive strength of the sample a was evaluated under conditions that the temperature X (° C.) was 250° C. and the heating time was 5 hours. Adhesive strength of the sample b was evaluated under conditions that the temperature X (° C.) was 265° C. and the heating time was 5 hours. Adhesive strength of the sample c was evaluated under conditions that the temperature X (° C.) was 280° C. and the heating time was 5 hours. Thus, three kinds of the peeling tests with different temperatures X (° C.) were performed with respect to each fixing roller (three tests at 250°

C., 265° C., and 280° C., respectively, were performed). The result of the evaluation is shown in the columns of "peeling test" in Table 2.

The following explains the method of measuring the amount of primer applied on the internal surface of the PFA tube with respect to each of the fixing rollers a to n shown in Table 2. The measurement was performed in manufacturing the fixing roller.

<Method of Measuring the Amount of Applied Primer>

(1) The PFA tube is fixed to the inside of the cylindrical mold.
(2) The weight W1 of the cylindrical mold is measured while the PFA tube is fixed.
(3) Primer is applied on the internal surface of the PFA tube with an application jig.
(4) The weight W2 of the cylindrical mold is measured 10 seconds after the application of the primer.
(5) Wp that is the amount of applied primer is calculated by the following formula A $$Wp=(W2-W1)/S \quad \text{(formula A)}$$

where S is a surface area of the internal surface of the PFA tube.

An examination of Table 2 shows that the unevenness in the adhesive strength of the PFA tube with respect to the silicone rubber has nothing to do with manufacture conditions such as time for an etching treatment of the PFA tube, first and second vulcanization temperatures, second vulcanization time, and time for drying primer, but the unevenness in the adhesive strength is greatly influenced by the amount of applied primer.

For that reason, in order to further examine the relation between the amount of applied primer and the adhesive strength and to examine what manufacture condition has a relation with the adhesive strength, the inventors of the present invention further manufactured 21 fixing rollers and made comparative examinations with respect to the 21 fixing rollers.

The 21 fixing rollers were manufactured under conditions as follows: the manufacture conditions such as the time for an etching treatment of the internal surface of the PFA tube, the first and second vulcanization temperatures, the second vulcanization time, and the time for drying primer were set to the standards shown in Table 2, conditions such as the amount of applied primer, the kind of primer, the thickness of the PFA tube, and the method of processing the internal surface of the PFA tube were parameters, and other conditions were the same as those in the case of the fixing rollers in FIG. 1. The 21 fixing rollers are hereinafter referred to as examples 1 to 13 and comparative examples 1 to 8. With respect to examples 1 to 13 and comparative examples 1 to 8, Table 3 shows the amount of applied primer, the kind of primer, the thickness of the PFA tube, and the method for treating the internal surface of the PFA tube.

TABLE 3

| | THICKNESS OF PFA TUBE (μm) | AMOUNT OF APPLIED PRIMER (mg/cm2) | KIND OF PRIMER | TREATMENT OF INTERNAL SURFACE OF PFA TUBE | PEELING TEST 250° C. | PEELING TEST 265° C. | PEELING TEST 280° C. | SECOND PRINTING AGING TEST (WRINKLE/DETACHMENT)·X·1 173 mm/s | 225 mm/s | 300 mm/s | 355 mm/s |
|---|---|---|---|---|---|---|---|---|---|---|---|
| COMPARATIVE EXAMPLE 1 | 30 | 0.222 | PRIMER A | TREATMENT A | X | X | X | ○/○ | Δ/○ | X/○ | X/○ |
| COMPARATIVE EXAMPLE 2 | 40 | 0.222 | PRIMER A | TREATMENT A | X | X | X | ○/○ | ○/○ | ○/Δ | ○/X |
| COMPARATIVE EXAMPLE 3 | 50 | 0.222 | PRIMER A | TREATMENT A | X | X | X | ○/○ | ○/○ | ○/X | ○/X |
| COMPARATIVE EXAMPLE 4 | 50 | 0.198 | PRIMER A | TREATMENT A | Δ | X | X | ○/○ | ○/○ | ○/Δ | ○/X |
| EXAMPLE 1 | 50 | 0.144 | PRIMER A | TREATMENT A | ○ | Δ | X | ○/○ | ○/○ | ○/○ | ○/Δ |
| EXAMPLE 2 | 50 | 0.138 | PRIMER A | TREATMENT A | ○ | ○ | X | ○/○ | ○/○ | ○/○ | ○/○ |
| EXAMPLE 3 | 50 | 0.084 | PRIMER A | TREATMENT A | ○ | ○ | X | ○/○ | ○/○ | ○/○ | ○/○ |
| EXAMPLE 4 | 50 | 0.078 | PRIMER A | TREATMENT A | ○ | ○ | X | ○/○ | ○/○ | ○/○ | ○/○ |
| EXAMPLE 5 | 50 | 0.060 | PRIMER A | TREATMENT A | ○ | ○ | X | ○/○ | ○/○ | ○/○ | ○/○ |
| EXAMPLE 6 | 50 | 0.036 | PRIMER A | TREATMENT A | ○ | ○ | Δ | ○/○ | ○/○ | ○/○ | ○/○ |
| EXAMPLE 7 | 50 | 0.012 | PRIMER A | TREATMENT A | ○ | ○ | Δ | ○/○ | ○/○ | ○/○ | ○/○ |
| EXAMPLE 8 | 50 | 0.006 | PRIMER A | TREATMENT A | ○ | ○ | Δ | ○/○ | ○/○ | ○/○ | ○/○ |
| EXAMPLE 9 | 50 | 0.180 | PRIMER B | TREATMENT A | ○ | ○ | — | ○/○ | ○/○ | ○/○ | ○/○ |
| EXAMPLE 10 | 50 | 0.018 | PRIMER B | TREATMENT A | ○ | ○ | — | ○/○ | ○/○ | ○/○ | ○/○ |
| COMPARATIVE EXAMPLE 5 | 50 | 0.180 | PRIMER C | TREATMENT A | X | X | — | ○/○ | ○/○ | ○/X | ○/X |
| COMPARATIVE EXAMPLE 6 | 50 | 0.018 | PRIMER C | TREATMENT A | X | X | — | ○/○ | ○/○ | ○/X | ○/X |
| EXAMPLE 11 | 50 | 0.036 | PRIMER A | TREATMENT B | ○ | ○ | Δ | ○/○ | ○/○ | ○/○ | ○/○ |
| COMPARATIVE EXAMPLE 7 | 50 | 0.036 | PRIMER A | TREATMENT C | X | X | X | ○/○ | ○/○ | ○/X | ○/X |
| COMPARATIVE EXAMPLE 8 | 40 | 0.222 | PRIMER A | TREATMENT A | X | X | X | ○/○ | ○/○ | ○/Δ | ○/X |
| EXAMPLE 12 | 40 | 0.198 | PRIMER A | TREATMENT A | Δ | X | X | ○/○ | ○/○ | ○/○ | ○/Δ |
| EXAMPLE 13 | 40 | 0.036 | PRIMER A | TREATMENT A | ○ | ○ | Δ | ○/○ | ○/○ | ○/○ | ○/○ |

The following details the result of comparison among the examples 1 to 13 and the comparative examples 1 to 8. The examples 1 to 13 and the comparative examples 1 to 8 were mounted on each of multifunctional apparatuses (A) to (D) as described below, and a second printing aging test was performed.

(A) Multifunctional apparatus with a process speed of 173 mm/s (printing speed: 41 sheet/min)
(B) Multifunctional apparatus with a process speed of 225 mm/s (printing speed: 45 sheet/min)
(C) Test model of multifunctional apparatus with a process speed of 300 mm/s (printing speed: 62 sheet/min)
(D) Test model of multifunctional apparatus with a process speed of 355 mm/s (printing speed: 70 sheet/min)

The second printing aging test was a test in which the degree of deterioration of the fixing roller was evaluated in a case where printing was performed with a target of two hundred thousand sheets in total in a 50-sheet-intermission mode (a mode of repeating an operation of continuously conveying 50 sheets and then stopping for 3 seconds). In the second printing aging test, a sheet whose size was A4 and whose weight per unit area was 60 g/m$^2$ was used. Further, in the second printing aging test, the temperature of the fixing roller was set to 190° C.

The peeling test was performed with respect to the examples 1 to 13 and the comparative examples 1 to 8, and the adhesive strength of the PFA tube with respect to the silicone rubber was evaluated. The procedure of the peeling test and the indices of the evaluation were already explained above.

Table 3 shows the results of the second printing aging test and the peeling test that were performed with respect to the examples 1 to 13 and the comparative examples 1 to 8.

The following makes an explanation as to Table 3.

Primers A to C in Table 3 represent as follows.

Primer A: resin primer (DY39-067, manufactured by Dow Corning Toray Co., Ltd.)
Primer B: rubber primer (DY39-051A, manufactured by Dow Corning Toray Co., Ltd.)
Primer C: rubber primer (DY39-051B, manufactured by Dow Corning Toray Co., Ltd.)

Treatments A to C in Table 3 represent as follows.

Treatment A: etching treatment in which liquid ammonia containing dissolved metallic sodium was used as a treatment solution
Treatment B: etching treatment with excimer laser
Treatment C: etching treatment in which a mixture solution of naphthalene and tetrahydrofuran to which metallic sodium was dissolved was used as a treatment solution In Table 3, evaluations (○, Δ, X) at the left side of each column of the "second printing aging test" represent as follows.

○: No wrinkles were generated during printing of two hundred thousand sheets
Δ: Wrinkles were generated at a time when the number of printed sheets was in a range of one hundred thousand to two hundred thousand
X: Wrinkles were generated before the number of printed sheets reached one hundred thousand In Table 3, evaluations (○, Δ, X) at the right side of each column of the "second printing aging test" represent as follows.

○: PFA tube was not detached during printing of two hundred thousand sheets
Δ: PFA tube was detached at a time when the number of printed sheets was in a range of one hundred thousand to two hundred thousand
X: PFA tube was detached before the number of printed sheets reached one hundred thousand The following makes an examination as to Table 3.

(a) Relation between the thickness of PFA tube and adhesive strength (comparative examples 1 to 3)

In the fixing roller, a PFA tube with a thickness of 30 μm has been generally used in order that elasticity of silicone rubber is impaired as little as possible, a wider nip width and a higher detachability of a sheet are secured, and unevenness in luster does not appear.

However, the result of the comparative example 1 shows that the fixing roller having a PFA tube with a thickness of 30 μm has a problem that use of the fixing roller with a process speed of 300 mm/s or more generates wrinkles on the PFA tube. This is because a higher process speed enlarges mechanical and thermal stress applied on the PFA tube.

Further, the results of the comparative examples 2 and 3 show that, in order to prevent wrinkles on the PFA tube of the fixing roller, it is effective to increase mechanical strength of the PFA tube by setting the thickness of the PFA tube to be 40 μm or more. However, the results also show that thicker PFA tube is more likely to be detached from the silicone rubber. The reason is as follows: making the PFA tube thicker reduces flexibility of the PFA tube, and accordingly the PFA tube cannot sufficiently follow deformation of the silicone rubber, resulting in larger shearing stress at an interface between the PFA tube and the silicone rubber.

(b) Relation between the amount of applied primer and adhesive strength (comparative examples 3 and 4 and examples 1 to 8)

The result of the peeling test performed with respect to the comparative examples 3 and 4 and the examples 1 to 8 shows that, as the amount of applied primer is smaller, the limit detachment temperature (limit temperature) of the fixing roller is higher.

The limit detachment temperature of the fixing roller was determined as follows: a plurality of peeling tests were performed with respect to the fixing roller (each test has different temperature X (° C.) of the heating surface of a hot plate), a peeling test with the highest temperature X (° C.) was selected out of peeling tests in which detachment of the PFA tube was not observed, and the temperature X (° C.) of the selected peeling test was regarded as the limit detachment temperature.

Particularly, in the present embodiment, the limit detachment temperature of the fixing roller was determined as follows: peeling tests with temperatures X (° C.) being 250° C., 265° C., and 280° C., respectively, were performed with respect to the fixing roller, a peeling test with the highest temperature X (° C.) was selected out of peeling tests in which detachment of the PFA tube was not observed, and the temperature X (° C.) of the selected peeling test was regarded as the limit detachment temperature (temperature X was a temperature (preset temperature) of the heating surface of the hot plate).

The following explains the limit detachment temperature, using the fixing roller of the example 2 as an example. As shown in Table 3, with respect to the fixing roller in the example 2, the peeling tests with temperatures X (° C.) being 250° C., 265° C., and 280° C., respectively, were performed (the three peeling tests were performed). Out of the three peeling tests, detachment of the PFA tube was not observed in the peeling tests with temperatures X (° C.) being 250° C. and 265° C., respectively. Out of the two peeling tests, the peeling test at 265° C. has the highest temperature X (° C.). Accordingly, the limit detachment temperature of the fixing roller of the example 2 was 265° C.

As the fixing roller has a higher limit detachment temperature, detachment of the PFA tube requires heating at a higher temperature. Accordingly, the limit detachment temperature is an index of difficulty in detachment of the PFA tube. Consequently, as the fixing roller has a higher limit detachment temperature, the fixing roller has larger adhesive strength, and as the fixing roller has a lower limit detachment temperature, the fixing roller has smaller adhesive strength.

The following discusses the relation between the amount of applied primer and the limit detachment temperature in more detail. For example, in the cases of the comparative examples 3 and 4 in each of which the amount of applied primer was 0.198 mg/cm$^2$ or more, the PFA tube was detached even in the peeling test with the temperature X (° C.) being 250° C. (evaluation was X or Δ). Accordingly, the limit detachment temperature of the comparative examples 3 and 4 were considered to be less than 250° C. In contrast, in the cases of the examples 2 to 8 in which the amount of applied primer was 0.144 mg/cm$^2$ or less, the limit detachment temperature of the PFA tube was 265° C. That is, as the amount of applied primer is smaller, the limit detachment temperature is higher, and as the amount of applied primer is larger, the limit detachment temperature is lower. Thus, a negative relation exists between the amount of applied primer and the limit detachment temperature. This is because too much amount of applied primer enlarges the thickness of a primer layer formed between the silicone rubber and the PFA tube, resulting in detachment (breakage) inside the primer layer.

In this point, in the examples 2 to 8 in which the amount of applied primer was 0.144 mg/cm$^2$, detachment of the PFA tube did not occur even when the process speed was high, i.e. 355 mm/s. Accordingly, the amount of applied primer is preferably 0.144 mg/cm$^2$ or less.

It is concerned that, when the amount of applied primer is too little, there is a partial area where the primer is not applied on the internal surface of the PFA tube, and the PFA tube may be detached from the area. The result of the example 8 shows that even when the amount of applied primer was 0.006 mg/cm$^2$, the PFA tube was not completely detached both in the peeling test and the second printing aging test. This shows that the PFA tube is not detached as long as the amount of applied primer is at least 0.006 mg/cm$^2$ (that is, the amount of applied primer is preferably 0.006 mg/cm$^2$ or more).

(c) Relation between the kind of primer and adhesive strength (comparative examples 5 and 6 and examples 2 to 10)

The results of the peeling tests performed with respect to the comparative examples 5 and 6 and the examples 2 to 10 show that the limit detachment temperature of the fixing roller greatly varies according to the kind of primer.

Specifically, in the cases of the examples 2 to 10 in which the primer A or B was used, the PFA tube was not detached in the peeling test with the temperature X (° C.) being 265° C. This shows that the limit detachment temperature in the examples 2 to 10 was 265° C. or more. In contrast, in the cases of the comparative examples 5 and 6 in which the primer C was used, the PFA tube was completely detached even in the peeling test with the temperature X (° C.) being 250° C. (evaluation was X). This shows that the limit detachment temperature of the comparative examples 5 and 6 was not more than 250° C. Therefore, the results of the peeling tests show that the fixing roller in which the primer A or B is used has higher adhesive strength of the PFA tube to the silicone rubber than the fixing roller in which the primer C is used.

Further, in the cases of the examples 2 to 10 in which the primer A or B was used, the PFA tube was not detached in the second printing aging test with the process speed of 355 mm/s. In contrast, in the cases of the comparative examples 5 and 6 in which the primer C was used, the PFA tube was detached in the second printing aging test with the process speed of 300 mm/s or more. Therefore, the results of the second printing aging tests show that the fixing roller in which the primer A or B is used has higher adhesive strength of the PFA tube to the silicone rubber than the fixing roller in which the primer C is used.

Table 4 shows the result of tests in which detachability of a sheet was evaluated with respect to the fixing roller using the primer A and the fixing roller using the primer B. In the tests, test printing was performed by multifunctional apparatuses on which the examples 5, 9, and 10 were mounted, respectively. The test printing was performed to examine whether a sheet could be smoothly detached from the fixing roller in a case where a solid image with three color layers and with a printing ratio of 100% (solid image made by overlapping a cyan image, a magenta image, and yellow image) was formed on a sheet whose weight per unit area was 60 g/m$^2$ (the amount of attached toner was 1.2 mg/cm$^2$). The test printing was performed plural times with a fixing temperature as a parameter.

TABLE 4

| FIXING TEMPERATURE (° C.) | EXAMPLE 5 PRIMER A (AMOUNT OF APPLICATION 0.06 mg/cm$^2$) | EXAMPLE 9 PRIMER B (AMOUNT OF APPLICATION 0.18 mg/cm$^2$) | EXAMPLE 10 PRIMER B (AMOUNT OF APPLICATION 0.018 mg/cm$^2$) |
|---|---|---|---|
| 200 | X | X | X |
| 190 | X | X | X |
| 180 | ○ | X | X |
| 170 | ○ | X | ○ |
| 160 | ○ | X | ○ |

In Table 4, ○ indicates that "a sheet could be smoothly detached", and X indicates that "a sheet could not be smoothly detached (detachment claw mark appeared)."

The result of Table 4 shows that the primer B (rubber type) is inferior to the primer A (resin type) in terms of detachability of a sheet. In consideration of the above result, primer to be applied on the internal surface (a surface of the resin layer that faces the elastic layer in FIG. 1) of the PFA tube is preferably resin type primer.

(d) Relation between a treatment for the internal surface of PFA tube and adhesive strength (comparative example 7 and examples 6 and 11) The results of the peeling tests performed with respect to the comparative example 7 and the examples 6 and 11 show that the limit detachment temperature of the PFA tube greatly varies according to the treatment on the internal surface of the PFA tube. Specifically, in the cases of the examples 6 and 11 subjected to the treatments A and B, respectively, the limit detachment temperature was 265° C. or more. In contrast, in the case of the comparative example 7 subjected to the treatment C, the PFA tube was completely detached even in the peeling test with the temperature X being 250° C. That is, the limit detachment temperature of the comparative example 7 was less than 250° C. Therefore, the result of the peeling test shows that the fixing roller subjected to the treatment A or B has larger adhesive strength of the PFA tube to the silicone rubber than the fixing roller subjected to the treatment C.

Further, in the examples 6 and 11 subjected to the treatments A and B, respectively, the PFA tube was not detached even in the second printing aging test with a high process speed of 355 mm/s. In contrast, in the comparative example 7 subjected to the treatment C, the PFA tube was detached in the second printing aging test with a process speed of 300 mm/s or more. Therefore, the result of the peeling test shows that the fixing roller subjected to the treatment A or B has larger adhesive strength of the PFA tube to the silicone rubber than the fixing roller subjected to the treatment C.

For that reason, the treatment to be applied on the internal surface of the PFA tube is preferably the treatment A or B.

(e) Adhesive strength of PFA tube with a thickness of 40 μm (comparative example 8, examples 12 and 13)

The aforementioned items (a) to (d) were the results of examinations on the PFA tube with a thickness of 50 μm. Accordingly, examinations were also made on the PFA tube with a thickness of 40 μm.

The results of the peeling test and the second printing aging test performed with respect to the comparative example 8 and the examples 12 and 13 show that, in the case where the thickness of the PFA tube was 40 μm, too, reducing the amount of applied primer enlarged adhesive strength of the PFA tube to the silicone rubber.

As described above, the results shown in the items (a) to (e) show that when the fixing roller had the limit detachment temperature of 250° C. or more, the PFA tube was not detached in the second printing aging test with a process speed of 300 mm/s or more, regardless of parameters having influence on adhesive strength of the PFA tube, i.e. parameters such as the thickness of the PFA tube, the treatment on the internal surface of the PFA tube, the kind of primer, and the amount of applied primer. Further, the results show that the peeling test of the present embodiment was valid as a test for adhesive strength of the PFA tube.

Further, the results show that the fixing roller whose limit detachment temperature was 265° C. or more in the peeling test did not cause the detachment of the PFA tube in the second printing aging test with a process speed of 355 mm/s or more.

In order to examine a relation between the limit detachment temperature of the fixing roller and the fixing temperature, the inventors of the present invention further manufactured seven fixing rollers, and performed a third printing aging test with respect to the seven fixing rollers. The seven fixing rollers were manufactured with different amount of applied primer, so that the seven fixing rollers had different limit detachment temperature. The seven fixing rollers are referred to as fixing rollers A to G as shown in Table 5.

(E) A test model of a multifunctional apparatus with a process speed of 300 mm/s (printing speed: 62 sheet/min) (manufactured by Sharp Corporation)

(F) A test model of a multifunctional apparatus with a process speed of 355 mm/s (printing speed: 70 sheet/min) (manufactured by Sharp Corporation)

In the third printing aging test, a sheet whose size was A4 and whose weight per unit area was 60 g/cm$^2$ was used.

Evaluations (○, Δ, X, -) in columns of "third printing aging test" in Table 5 represent as follows.

○: PFA tube was not detached during printing of two hundred thousand sheets.

Δ: PFA tube was detached at its interface when the number of printed sheets was in a range of one hundred thousand to two hundred thousand sheets.

X: PFA tube was detached at its interface before the number of printed sheets reached one hundred thousand sheets.

-: Evaluation was not performed (because it was considered that detachment of PFA tube at its interface would not occur)

Figure 4:
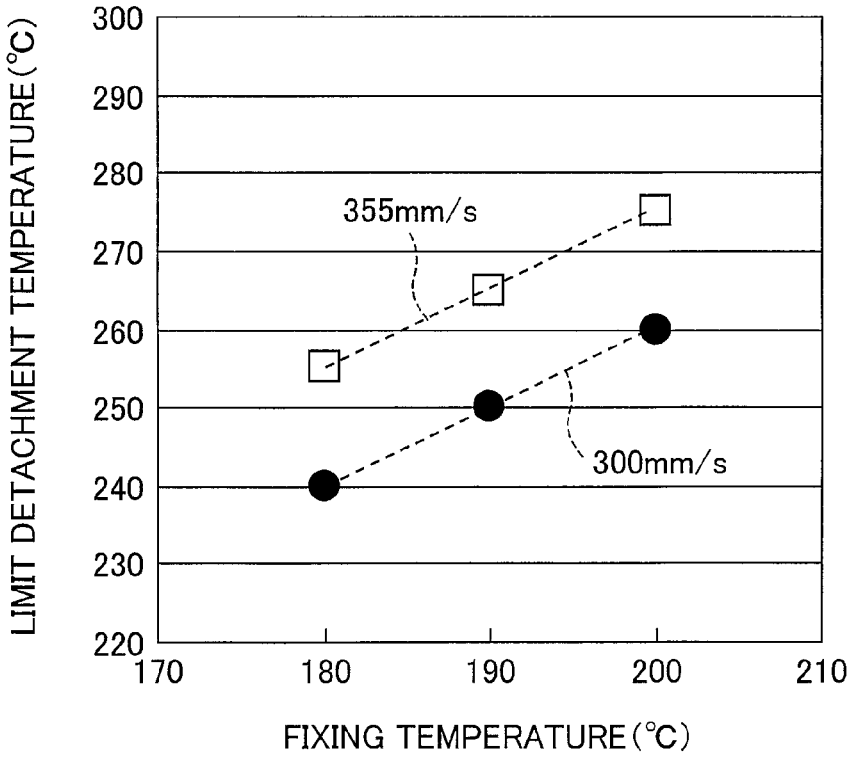
FIG. 4 is a graph showing a relation between a fixing temperature and a limit detachment temperature.

FIG. 4 is a simple graph showing a relation between the limit detachment temperature of the fixing roller and the fixing temperature based on the results of the tests with a process speed of 300 mm/s and a process speed of 355 mm/s in Table 5.

As shown in FIG. 4 and Table 5, in order to secure detachment resistance of the PFA tube, a multifunctional apparatus with a higher fixing temperature requires a fixing roller with a higher limit detachment temperature.

In particular, in a case where evaluation "○" in the columns of the "third printing aging test" in Table 5 is regarded as being passable, the result of Table 5 shows as follows.

In the case of the multifunctional apparatus with a process speed of 300 mm/s or more, the fixing roller that meets the following relation is regarded as being passable $$Tr \geqq Tc+60$$

where Tr represents the limit detachment temperature of the fixing roller and Tc represents the fixing temperature.

TABLE 5

| | | | THIRD PRINTING AGING TEST | | | | | |
|---|---|---|---|---|---|---|---|---|
| | | | PROCESS SPEED 300 mm/sec | | | PROCESS SPEED 355 mm/sec | | |
| FIXING ROLLER | AMOUNT OF APPLIED PRIMER (mg/cm2) | LIMIT DETACHMENT TEMPERATURE (° C.) | FIXING TEMPERATURE 180° C. | FIXING TEMPERATURE 190° C. | FIXING TEMPERATURE 200° C. | FIXING TEMPERATURE 180° C. | FIXING TEMPERATURE 190° C. | FIXING TEMPERATURE 200° C. |
| FIXING ROLLER A | 0.250 | 230 | X | — | — | — | — | — |
| FIXING ROLLER B | 0.222 | 240 | ○ | X | — | — | X | — |
| FIXING ROLLER C | 0.198 | 245 | ○ | Δ | — | X | X | — |
| FIXING ROLLER D | 0.170 | 255 | — | ○ | X | ○ | X | — |
| FIXING ROLLER E | 0.144 | 260 | — | ○ | ○ | ○ | Δ | — |
| FIXING ROLLER F | 0.078 | 265 | — | ○ | — | — | ○ | X |
| FIXING ROLLER G | 0.036 | 275 | — | ○ | — | — | ○ | ○ |

The third printing aging test was a test in which the degree of deterioration of the fixing roller was evaluated in a case where the fixing rollers A to G were mounted on each of (E) and (F) as described below and printing was performed with a target of two hundred thousand sheets in total in a 50-sheet-intermission mode with respect to each of three fixing temperatures 180° C., 190° C., and 200° C.

In the case of the multifunctional apparatus with a process speed of 355 mm/s or more, the fixing roller that meets the following relation is regarded as being passable.

$$Tr \geqq Tc+75$$

As long as the fixing roller meets the relation of Tr≧Tc+60, a resin layer of the fixing roller is less likely to be detached (detached at its interface) from an elastic layer of the fixing roller, even when the resin layer has a thickness of 40 μm or more and is used in a high-speed image forming apparatus with a peripheral velocity of the fixing roller being 300 mm/s or more. Furthermore, as long as the fixing roller meets the relation of Tr≧Tc+75, a resin layer of the fixing roller is less likely to be detached (detached at its interface) from an elastic layer of the fixing roller, even when the resin layer has a thickness of 40 μm or more and is used in a high-speed image forming apparatus with a peripheral velocity of the fixing roller being 355 mm/s or more. That is, the fixing roller that meets the above relation allows prevention of wrinkles on the PFA tube or detachment of the PFA tube, secures stable quality, and does not require cost up.

Further, the elastic layer of the fixing roller of the present embodiment is made of silicone rubber. However, the elastic layer is not limited to silicone rubber as long as the elastic layer is made of a heat-resistive elastic material. The elastic layer may be fluorine rubber or a mixture of silicone rubber and fluorine rubber.

Further, the resin layer of the fixing roller of the present embodiment is made of the PFA tube. However, the resin layer is not limited to the PFA (tetrafluoroethylene-perfluoroalkylvinylether copolymer) as long as the resin layer is made of resin with excellent heat-resistance and mold-releasability (fluorine resin). The resin layer may be made of PTFE (polytetrafluoroethylene) or a mixture of PFA and PTFE.

Further, in the case of the fixing roller whose resin layer has a thickness of 40 μm or more, in order that the fixing roller can be used at a higher speed, it is preferable that the elastic layer is made thicker, silicone rubber constituting the elastic layer is made to have lower hardness, and a fixing nip width is made wider. Specifically, it is preferable to design the elastic layer so that the elastic layer has a thickness of 2 mm or more and silicone rubber has ASKER C hardness of 20 degree or less. However, such design in a conventional fixing roller would enlarge deformation of an elastic layer and would easily cause detachment of a resin layer.

However, in the case of the fixing roller that meets the relation Tr≧Tc+60 or Tr≧Tc+75, detachment of the resin layer can be suppressed even when the thickness of the resin layer is 40 μm or more, the thickness of the elastic layer is 2 mm or more, and ASKER C hardness of silicone rubber constituting the elastic layer is 20 degrees or less.

The following details a fixing apparatus on which the aforementioned fixing roller of the present embodiment is mounted.

<Explanation of Fixing Apparatus>

With respect to a recording paper (sheet, recording material) on which surface an unfixed color toner image is formed, the fixing apparatus of the present embodiment fixes the toner image on the sheet by way of heat and pressure. The unfixed toner image is made of a developer (hereinafter referred to as toner) such as a nonmagnetic unary developer (nonmagnetic toner), a nonmagnetic binary developer (nonmagnetic toner and carrier), and a magnetic developer (magnetic toner).

Figure 5:
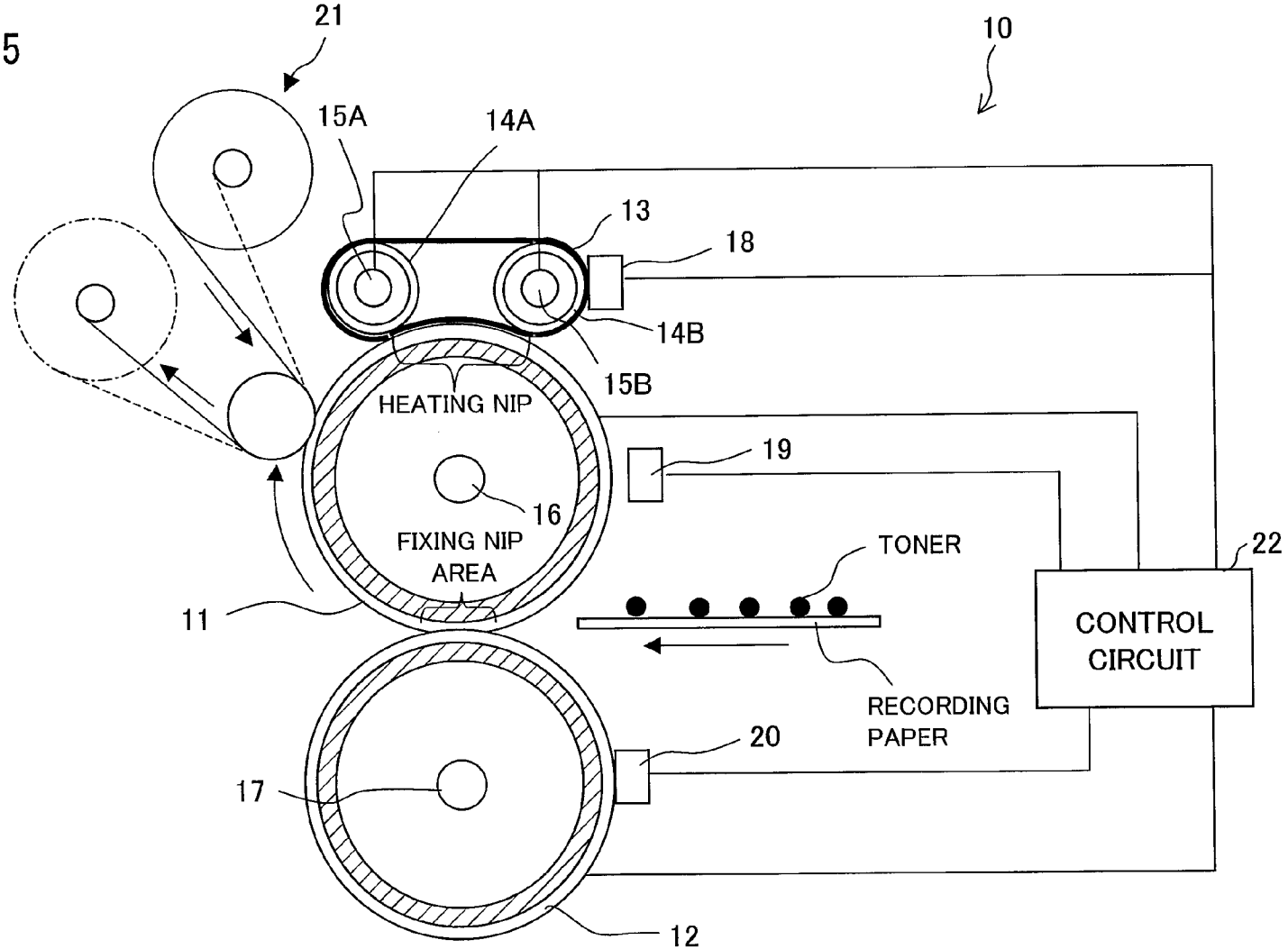
FIG. 5 is a schematic drawing illustrating a fixing apparatus including a fixing roller.

FIG. 5 is a cross sectional drawing illustrating a structure of a fixing apparatus 10 of the present embodiment. As illustrated in FIG. 5, the fixing apparatus 10 includes: a first fixing roller 11; a second fixing roller (pressurizing roller) 12; an external heating belt 13 serving as an external heating member; heating rollers 14A and 14B for suspending and heating the external heating belt 13; heater lamps 15A and 15B serving as heat sources to heat the heating rollers 14A and 14B, respectively; a heater lamp 16 serving as a heat source to heat the first fixing roller 11; a heater lamp 17 serving as a heat source to heat the second fixing roller 12; thermistors 18, 19, and 20 serving as temperature sensors that are temperature detecting means for detecting temperatures of the external heating belt 13, the first fixing roller 11, and the second fixing roller 12, respectively; and a web cleaner 21 for cleaning the first fixing roller 11.

The first fixing roller 11 and the second fixing roller 12 are pressed to each other with a predetermined load (here, 600 N) to form a fixing nip area (a portion at which the first fixing roller 11 and the second fixing roller 12 touch each other) therebetween. In the present embodiment, a length of the fixing nip area in a sheet transfer direction is 9 mm.

A recording paper passes through the fixing nip area, so that a toner image is fixed on the recording paper. When the recording paper passes through the fixing nip area, the first fixing roller 11 contacts a surface of the recording paper on which the toner image is formed, whereas the second fixing roller 12 contacts a surface of the recording paper that is opposite to the surface on which the toner image is formed.

The heater lamp 16 for heating the first fixing roller 11 is provided inside the first fixing roller 11. The heater lamp 16 receives a power from the control circuit 22 and emits light, thereby irradiating an infrared. Consequently, the internal surface of the first fixing roller 11 absorbs the infrared and is heated, so that the whole part of the fixing roller 11 is heated.

The first fixing roller 11 is heated to have a fixing temperature predetermined for the first fixing roller 11, so that the first fixing roller 11 heats the recording paper which passes through the fixing nip area of the fixing apparatus 10 and on which the unfixed toner image is formed. The first fixing roller 11 has a diameter of 50 mm and has a three-layered structure including a core, an elastic layer, and a resin layer (surface layer, mold-release layer) in this order from the inner side of the first fixing roller 11.

The core is made of a metal such as iron, stainless steel, aluminum, and copper or made of an alloy thereof for example. In this case, the core is an aluminum core with a thickness of 3 mm. Further, silicone rubber is suitable for the elastic layer and fluorine resin such as PFA and PTFE is suitable for the resin layer. Here, the elastic layer is made of silicone rubber with a thickness of 2 mm and the resin layer is made of a PFA tube with a thickness of 50 μm.

As with the first fixing roller 11, the second fixing roller 12 has a diameter of 50 mm, and has a structure in which an elastic layer made of silicone rubber with a thickness of 2 mm is formed on the external surface of an aluminum core with a thickness of 3 mm and a resin layer (surface layer, mold release layer) made of a PFA tube with a thickness of 50 μm is formed on the elastic layer. In a fixing process, the second fixing roller 12 is heated by an infrared from the heater lamp 17 so as to have a fixing temperature predetermined for the second fixing roller 12.

The external heating belt 13 has a diameter of 30 mm. The external heating belt 13 contacts a surface of the first fixing roller 11 while heated at a predetermined temperature (here, 220° C.), thereby heating the surface of the first fixing roller 11. The external heating belt 13 is suspended by the heating rollers 14A and 14B each with a diameter of 15 mm. The heater lamps 15A and 15B serving as heating sources to heat the heating rollers 14A and 14B are provided inside the heating rollers 14A and 14B, respectively.

The heater lamps 15A and 15B receive a power from the control circuit 22 and emit light, thereby irradiating an infrared. Thus, peripheral surfaces of the heating rollers 14A and 14B are heated, and the external heating belt 13 is indirectly heated via the heating rollers 14A and 14B.

The external heating belt 13 is provided on the first fixing roller 11 so as to be positioned at the upper stream side from the fixing nip area. When the external heating belt 13 stands by, the external heating belt 13 is detached from the first fixing roller 11. When the external heating belt 13 operates, the external heating belt 13 is pressed to the first fixing roller 11 with a predetermined pressure (here, 40 N). A heating nip section is provided between the external heating belt 13 and the first fixing roller 11. In the present embodiment, a length of the heating nip section in a sheet transfer direction is 20 mm.

The external heating belt 13 rotates by being driven by rotation of the first fixing roller 11. The heating rollers 14A and 14B rotate by being driven by the rotation of the external heating belt 13.

The external heating belt 13 has a two-layered structure in which a synthetic resin material (e.g. fluorine resin such as PFA and PTFE) excellent in heat-resistance and mold-releasability is formed as a mold release layer on a surface of a base material with a hollow cylindrical shape that is made of heat-resistive resin such as polyimide or a metal material such as stainless and nickel. In the present embodiment, the external heating belt 13 is configured such that a mold-release layer with a thickness of 15 μm that is a mixture of PFA and PTFE is provided on a surface of a polyimide base material with a thickness of 90 μm. Further, in order to reduce a deviation force that deviates the external heating belt 13, the inside of the belt basic material may be coated with fluorine resin etc.

Each of the heating rollers 14A and 14B is made of a metal core with a hollow cylindrical shape that is made of aluminum or iron material. Further, in order to reduce a deviation force that deviates the external heating belt 13, the surface of the metal core may be coated with fluorine resin etc.

The thermistors 18, 19, and 20 serving as temperature detecting means are provided on peripheral surfaces of the external heating belt 13, the first fixing roller 11, and the second fixing roller 12, respectively, so as to detect surface temperatures thereof. In accordance with data of the surface temperatures detected by the thermistors 18, 19, and 20, the control circuit 22 serving as temperature control means controls feeding of a power to the heater lamps 15A, 15B, 16, and 17, so that the first fixing roller 11, the second fixing roller 12, and the external heating belt 13 have predetermined surface temperatures.

A recording paper P on which an unfixed toner image is formed is transferred to the fixing nip area with a predetermined process speed (fixing speed), and the toner image is fixed on the recording paper P with use of heat and pressure. In the present embodiment, the process speed is 300 mm/s or 355 mm/s. Further, in the case where the process speed is 355 m/s, a printing speed (copying speed, number of printed paper per one minute) is 70 sheet/min. In the case where the process speed is 300 m/s, a printing speed is 62 sheet/min.

Further, not illustrated in FIG. 5, a driving motor (driving means) is provided to rotate the first fixing roller 11 so that a recording paper passes through the fixing nip area. Further, the second fixing roller 12 rotates by being driven by the rotation of the first fixing roller 11. That is, as illustrated in FIG. 5, the first fixing roller 11 and the second fixing roller 12 rotate adversely with respect to each other.

The fixing roller of the present invention is applicable not only to the fixing apparatus 10 including the external heating belt 13, but also to a fixing apparatus including an external heating roller and to a fixing apparatus without the external heating means. Further, the fixing roller of the present invention is applicable to either of the first fixing roller 11 and the second fixing roller 12. That is, the fixing roller of the present invention is applicable to a roller that is heated to have a predetermined temperature at a time of the fixing process and that is pressed to a surface of a recording paper on which a toner image is formed, or applicable to a roller that is pressed to a surface of the recording paper opposite to the surface on which a toner image is formed.

Further, in the fixing apparatus of the present embodiment, both of the first fixing roller 11 and the second fixing roller 12 include an internal heat source. However, the fixing roller of the present invention is also applicable to a fixing apparatus in which only one of fixing rollers includes an internal heat source.

The following details an image forming apparatus including the aforementioned fixing apparatus of the present embodiment.

<Explanation of Image Forming Apparatus>

Figure 6:
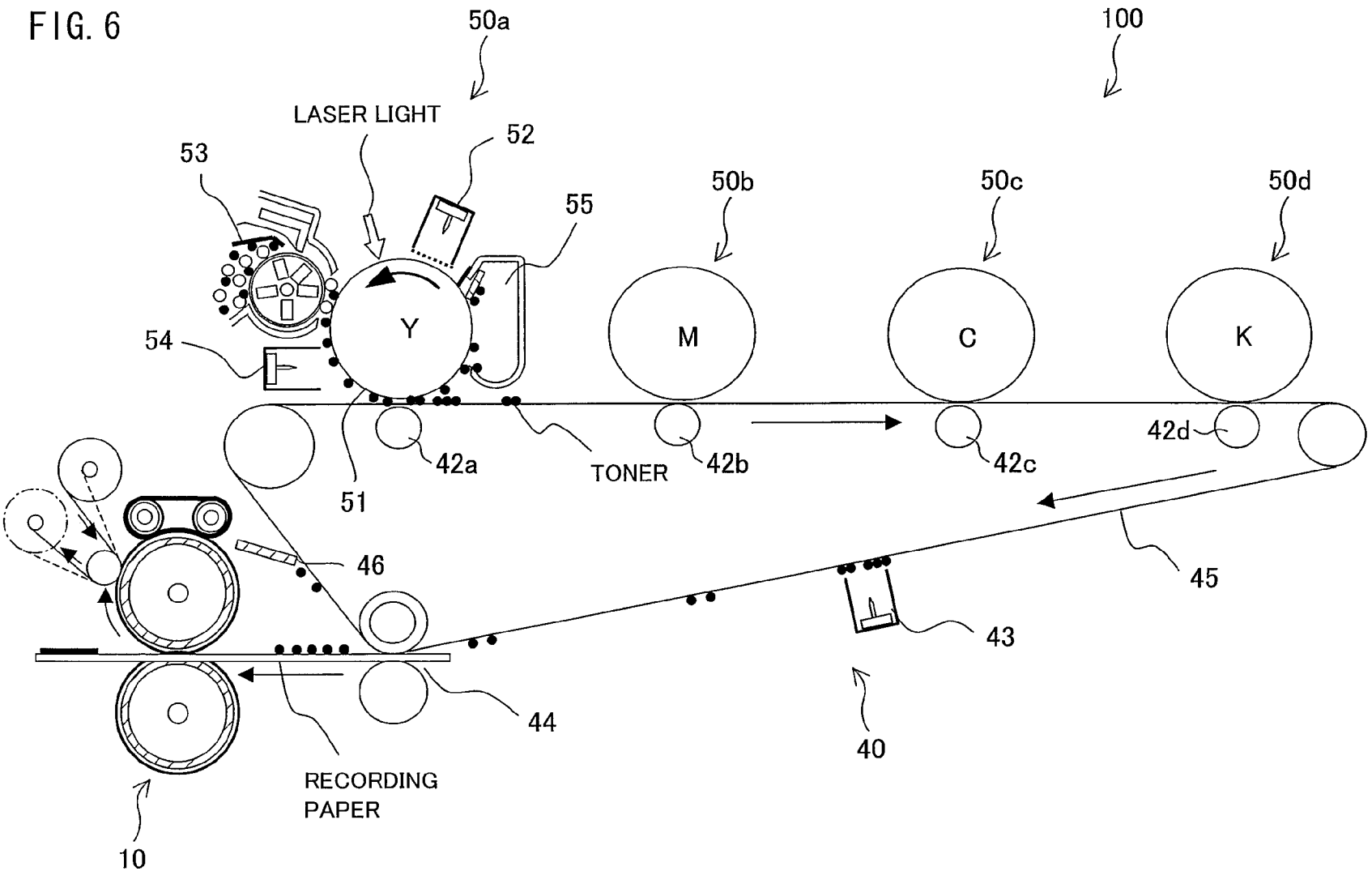
FIG. 6 is a schematic drawing illustrating a part of an internal structure of an image forming apparatus including the fixing apparatus in FIG. 5.

FIG. 6 is a cross sectional drawing schematically illustrating a structure of an image forming apparatus 100 that includes the fixing apparatus 10 of the present embodiment. The image forming apparatus 100 is an electrophotographic printer. The image forming apparatus 100 is of a so-called tandem type and is based on an intermediate transfer method. The image forming apparatus 100 can form a full color image.

As illustrated in FIG. 6, the image forming apparatus 100 includes: visible image forming units 50*a* to 50*d* for four colors (Y, M, C, K), respectively; a transfer unit 40; and the fixing apparatus 10.

The transfer unit 40 includes: an intermediate transfer belt 45 (image carrier); four first transfer devices 42*a* to 42*d*; a charge device 43 for charging before a second transfer; a second transfer device 44; and a transfer cleaner 46.

The intermediate transfer belt 45 is a belt where toner images corresponding to four colors visualized by the visible image forming units 50*a* to 50*d*, respectively, are overlapped and transferred, and the transferred toner images are retransferred to a recording paper. Specifically, the intermediate transfer belt 45 is an endless belt, and is suspended by a pair of a driving roller and an idling roller, and is driven with a predetermined peripheral velocity at a time of forming an image.

The first transfer devices 42*a* to 42*d* are provided for the visible image forming units 50*a* to 50*d*, respectively. The first transfer devices 42*a* to 42*d* are positioned opposite to the corresponding visible image forming units 50*a* to 50*d* with the intermediate transfer belt 45 therebetween.

The charging device 43 for charging before a second transfer is used to recharge the toner image that has been overlapped and transferred on the intermediate transfer belt 45. The charging device 43 charges the toner image by emitting ions.

The second transfer device 44 retransfers, on a recording paper, the toner image having been transferred on the intermediate transfer belt 45. The second transfer device 44 is provided so as to contact the intermediate transfer belt 45. The transfer cleaner 46 cleans the surface of the intermediate transfer belt 45 after retransfer of the toner image.

The transfer unit 40 is configured such that the first transfer devices 42*a* to 42*d*, the charging device 43, the second transfer device 44, and the transfer cleaner 46 are provided in this order along the intermediate transfer belt 45 from the upper stream in a transfer direction of the intermediate transfer belt 45.

Further, the fixing apparatus 10 is provided at the down stream side in a recording paper transfer direction of the second transfer device 44. The fixing apparatus 10 fixes, on the recording paper, the toner image having been transferred on the recording paper by the second transfer device 44.

Further, the four visible image forming units 50*a* to 50*d* are provided along the intermediate transfer belt 45 so as to contact the intermediate transfer belt 45. The four visible image forming units 50*a* to 50*d* are the same with one another except that they use different colors, which are yellow (Y), magenta (M), cyan (C), and black (K), respectively. The following explains only the visible image forming unit 50*a*. Explanations as to the visible image forming units 50*b* to 50*d* are omitted here.

The visible image forming unit 50*a* includes: a photoconductor drum (image carrier) 51; a latent image charging device 52 provided near the photoconductor drum 51; a laser writing unit (laser light irradiating means; not shown); a developing device 53; a charging device 54 for charging before a first transfer; and a cleaner 55.

The latent image charging device 52 charges the surface of the photoconductor drum 51 so that the surface has a predetermined potential. In the present embodiment, the photoconductor drum 51 is charged by ions emitted from the latent image charging device 52.

The laser writing unit emits laser light to the photoconductor drum 51 (exposes the photoconductor drum 51) in accordance with image data received from an external device, and writes an electrostatic latent image on the evenly charged photoconductor drum 51 by scanning of a light image.

The developing device 53 supplies toner to the electrostatic latent image formed on the surface of the photoconductor drum 51 and visualizes the electrostatic latent image so as to form a toner image. The charging device 54 for charging before a first transfer recharges, before transfer, the toner image formed on the surface of the photoconductor drum 51. In the present embodiment, the toner image is charged by emitting ions.

The cleaner 55 removes and recovers the toner remaining on the photoconductor drum 51 after the toner image has been transferred to the intermediate transfer belt 45, allowing a new electrostatic latent image and a toner image to be formed on the photoconductor drum 51.

The latent image charging device 52, the laser writing unit, the developing device 53, the charging device 54, the first transfer device 42*a*, and the cleaner 55 are provided around the photoconductor drum 51 of the visible image forming unit 50*a* so as to be positioned in this order from the upper stream in a rotating direction of the photoconductor drum 51.

The following explains an image forming operation of the image forming apparatus 100.

The image forming apparatus 100 acquires image data from the external device. A driving unit (not shown) of the image forming apparatus 100 causes the photoconductor drum 51 to rotate at a predetermined speed in a direction of the arrow shown in FIG. 6, and the latent image charging device 52 charges the surface of the photoconductor drum 51 so that the surface has a predetermined potential.

Subsequently, the laser writing unit exposes the surface of the photoconductor drum 51 in accordance with the acquired image data so as to write an electrostatic latent image on the surface of the photoconductor drum 51 in accordance with the image data. Then, the developing device 53 supplies toner to the electrostatic latent image formed on the surface of the photoconductor drum 51. Thus, toner is attached to the electrostatic latent image and a toner image is formed.

The first transfer device 42*a* applies, on the photoconductor drum 51, a bias voltage whose polarity is opposite to that of the toner image formed on the surface of the photoconductor drum 51, so that the toner image is transferred from the photoconductor drum 51 to the intermediate transfer belt 45.

The visible image forming units 50*a* to 50*d* sequentially performs the above operation, so that four toner images of Y, M, C, and K, respectively, are sequentially overlapped on the intermediate transfer belt 45.

The overlapped toner image is transferred by the intermediate transfer belt 45 to the charging device 43, and is recharged by the charging device 43. Then, the intermediate transfer belt 45 carrying the recharged toner image is pressed by the second transfer device 44 to a recording paper having been fed from a paper-feeding unit (not shown), so that the toner image is transferred on the recording paper.

Thereafter, the fixing apparatus 10 fixes the toner image on the recording paper, and the recording paper on which the image is recorded is ejected to a paper-ejecting unit (not shown). After the transfer, the toner remaining on the photoconductor drum 51 is removed and recovered by the cleaner 55, and the toner remaining on the intermediate transfer belt 45 is removed and recovered by the transfer cleaner 46. With the above operations, the recording paper can be printed suitably.

As described above, a fixing roller of the present invention is a fixing roller that is included in a fixing apparatus of an image forming apparatus and that includes: a core; an elastic layer made of an elastic material, formed around the core; and a resin layer made of fluorine resin, formed around the elastic layer, the resin layer having a thickness of 40 μm or more, a peripheral velocity of the fixing roller being set to be 300 mm/s or more in the fixing apparatus, the fixing roller meeting a relation $Tr \geqq Tc+60$ where Tr (° C.) is a limit temperature obtained in a detachment test and Tc (° C.) is a temperature of the fixing roller at which the fixing apparatus performs a fixing process, the detachment test being performed in such a manner that a part of the fixing roller that includes the elastic layer and the resin layer is cut out as a sample, the sample is heated in contact with a heating material with a temperature X (° C.) while being subjected to application of a load, and it is confirmed whether or not the resin layer is detached from the elastic layer in the sample after the heating, the detachment test being performed plural times with different temperatures X (° C.), a detachment test with a highest temperature X (° C.) being selected out of one or more detachment tests in which detachment between the resin layer and the elastic layer is not observed, and the temperature X (° C.) of the selected detachment test being regarded as the limit temperature.

With the fixing roller that meets the relation $Tr \geqq Tc+60$, when the resin layer has a thickness of 40 μm or more and the fixing roller is used in an image forming apparatus in which a peripheral velocity of a fixing roller is set to 300 mm/s or more, the resin layer is less likely to be detached (detached at its interface) from the elastic layer.

As described above, a fixing roller of the present invention is a fixing roller that is included in a fixing apparatus of an image forming apparatus and that includes: a core; an elastic layer made of an elastic material, formed around the core; and a resin layer made of fluorine resin, formed around the elastic layer, the resin layer having a thickness of 40 μm or more, a peripheral velocity of the fixing roller being set to be 355 mm/s or more in the fixing apparatus, the fixing roller meeting a relation $Tr \geqq Tc+75$ where Tr (° C.) is a limit temperature obtained in a detachment test and Tc (° C.) is a temperature of the fixing roller at which the fixing apparatus performs a fixing process, the detachment test being performed in such a manner that a part of the fixing roller that includes the elastic layer and the resin layer is cut out as a sample, the sample is heated in contact with a heating material with a temperature X (° C.) while being subjected to application of a load, and it is confirmed whether or not the resin layer is detached from the elastic layer in the sample after the heating, the detachment test being performed plural times with different temperatures X (° C.) with respect to each test, the detachment test being performed plural times with different temperatures X (° C.), a detachment test with a highest temperature X (° C.) being selected out of one or more detachment tests in which detachment between the resin layer and the elastic layer is not observed, and the temperature X (° C.) of the selected detachment test being regarded as the limit temperature.

With the fixing roller that meets the relation Tr≧Tc+75, when the resin layer has a thickness of 40 μm or more and the fixing roller is used in an image forming apparatus in which a peripheral velocity of a fixing roller is set to 355 mm/s or more, the resin layer is less likely to be detached (detached at its interface) from the elastic layer.

In the fixing roller of the present invention, the elastic material is preferably heat-resistive rubber. In particular, silicone rubber is preferable. However, the elastic material is not limited to silicone rubber, and may be fluorine rubber, a mixture of silicone rubber and fluorine rubber, etc.

In the fixing roller of the present invention, the fluorine resin is preferably a material with excellent heat-resistance and mold-releasability. In particular, PFA is preferable. However, the fluorine resin is not limited to PFA, and may be PTFE, a mixture of PFA and PTFE, etc.

In order that a fixing roller can be used at a high speed, it is preferable to thicken an elastic layer, to cause an elastic material constituting the elastic layer to have low hardness, and to enlarge a fixing nip width. However, if a conventional fixing roller would be designed so, deformation of the elastic layer would increase, which would be more likely to cause detachment of the resin layer. Specifically, in the case of a conventional fixing roller whose resin layer has a thickness of 40 μm or more, when an elastic layer has a thickness of 2 mm or more and an elastic material constituting the elastic layer has ASKER C hardness of 20 degrees or less, the resin layer is more likely to be detached. However, in the case of the fixing roller that meets the relation Tc≧Tc+60 or Tr≧Tc+75, the detachment of the resin layer is prevented even when the resin layer has a thickness of 40 μm or more, the elastic layer has a thickness of 2 mm or more, and the elastic material constituting the elastic layer has ASKER C hardness of 20 degrees or less.

When the amount of primer applied on a surface of the resin layer that faces the elastic layer is too much, a thick primer layer is formed between the resin layer and the elastic layer. Breakage is likely to occur in the thick primer layer, and accordingly the resin layer is more likely to be detached from the elastic layer. For that reason, only a necessary amount of primer should be applied on the surface of the resin layer that faces the elastic layer. Specifically, the amount of applied primer is preferably 0.144 g/cm$^2$ or less.

In contrast, when the amount of primer applied on the surface of the resin layer that faces the elastic layer is too little, there is a partial area where the primer is not applied, and the resin layer may be detached from the elastic layer at the area. For that reason, a sufficient amount of primer should be applied on the surface of the resin layer that faces the elastic layer. Specifically, the amount of applied primer is preferably 0.006/cm$^2$ or more.

When resin primer is used as primer to be applied on the surface of the resin layer that faces the elastic layer, sufficient adhesive strength between the elastic layer and the resin layer is secured. However, when rubber primer is used, there is a case where the adhesive strength drops or detachability of a sheet in a fixing process drops. For that reason, the primer to be applied on the surface of the resin layer that faces the elastic layer is preferably resin primer.

In the fixing roller of the present invention, performing an etching treatment on the surface of the resin layer that faces the elastic layer improves nonadhesiveness (inertness) of fluorine resin that constitutes the resin layer, which facilitates application of primer on the resin layer and increases adhesive strength between the resin layer and the elastic layer. Preferable examples of the etching treatment include a chemical etching treatment in which liquid ammonia containing dissolved metallic sodium is used as a treatment solution, and a physical etching treatment in which excimer laser is emitted.

The present invention may be expressed as a fixing apparatus including the above fixing roller or may be expressed as an image forming apparatus including the fixing apparatus.

The image forming apparatus to which the fixing apparatus of the present invention is applicable may be a monochrome image forming apparatus instead of a color image forming apparatus. Further, the fixing roller of the present invention is applicable to an electrophotographic printer, an electrophotographic copying machine, and an electrophotographic multifunctional apparatus.

The present invention is not limited to the above embodiments, and a variety of modifications are possible within the scope of the following claims, and embodiments obtained by combining technical means respectively disclosed in the above embodiments are also within the technical scope of the present invention.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A fixing roller that is included in a fixing apparatus of an image forming apparatus and that includes: a core; an elastic layer made of an elastic material, formed around the core; and a resin layer made of fluorine resin, formed around the elastic layer, the resin layer having a thickness of 40 μm or more, a peripheral velocity of the fixing roller being set to be 300 mm/s or more in the fixing apparatus, the fixing roller meeting a relation Tr≧Tc+60 where Tr (° C.) is a limit temperature obtained in a detachment test and Tc (° C.) is a temperature of the fixing roller at which the fixing apparatus performs a fixing process, the detachment test being performed in such a manner that a part of the fixing roller that includes the elastic layer and the resin layer is cut out as a sample, the sample is heated in contact with a heating material with a temperature X (° C.) while being subjected to application of a load, and it is confirmed whether or not the resin layer is detached from the elastic layer in the sample after the heating, the detachment test being performed plural times with different temperatures X (° C.), a detachment test with a highest temperature X (° C.) being selected out of one or more detachment tests in which detachment between the resin layer and the elastic layer is not observed, and the temperature X (° C.) of the selected detachment test being regarded as the limit temperature.

2. The fixing roller as set forth in claim 1, wherein the elastic material is silicone rubber.

3. The fixing roller as set forth in claim 1, wherein the fluorine resin is PEA (tetrafluoroethylene-perfluoroalkylvinylether copolymer).

4. The fixing roller as set forth in claim 1, wherein the elastic layer has a thickness of 2 mm or more.

5. The fixing roller as set forth in claim 1, wherein the elastic material has ASKER C hardness of 20 degrees or less.

6. The fixing roller as set forth in claim 1, wherein primer is applied on a surface of the resin layer that faces the elastic layer, and an amount of applied primer per unit area is 0.144 g/cm2 or less.

7. The fixing roller as set forth in claim 6, wherein the amount of applied primer per unit area is 0.006 g/cm2 or more.

8. The fixing roller as set forth in claim 6, wherein the primer is resin primer.

9. The fixing roller as set forth in claim 6, wherein an etching treatment is performed on a surface of the resin layer that faces the elastic layer, the etching treatment being such that liquid ammonia containing dissolved metallic sodium is used as a treatment solution.

10. The fixing roller as set forth in claim 6, wherein an etching treatment in which excimer laser is irradiated is performed on a surface of the resin layer that faces the elastic layer.

11. A fixing roller that is included in a fixing apparatus of an image forming apparatus and that includes: a core; an elastic layer made of an elastic material, formed around the core; and a resin layer made of fluorine resin, formed around the elastic layer, the resin layer having a thickness of 40 μm or more, a peripheral velocity of the fixing roller being set to be 355 mm/s or more in the fixing apparatus, the fixing roller meeting a relation Tr≧Tc+75 where Tr (° C.) is a limit temperature obtained in a detachment test and Tc (° C.) is a temperature of the fixing roller at which the fixing apparatus performs a fixing process, the detachment test being performed in such a manner that a part of the fixing roller that includes the elastic layer and the resin layer is cut out as a sample, the sample is heated in contact with a heating material with a temperature X (° C.) while being subjected to application of a load, and it is confirmed whether or not the resin layer is detached from the elastic layer in the sample after the heating, the detachment test being performed plural times with different temperatures X (° C.), a detachment test with a highest temperature X (° C.) being selected out of one or more detachment tests in which detachment between the resin layer and the elastic layer is not observed, and the temperature X (° C.) of the selected detachment test being regarded as the limit temperature.

12. The fixing roller as set forth in claim 11, wherein the elastic material is silicone rubber.

13. The fixing roller as set forth in claim 11, wherein the fluorine resin is PEA (tetrafluoroethylene-perfluoroalkylvinylether copolymer).

14. The fixing roller as set forth in claim 11, wherein the elastic layer has a thickness of 2 mm or more.

15. The fixing roller as set forth in claim 11, wherein the elastic material has ASKER C hardness of 20 degrees or less.

16. The fixing roller as set forth in claim 11, wherein primer is applied on a surface of the resin layer that faces the elastic layer, and an amount of applied primer per unit area is 0.144 g/cm2 or less.

17. The fixing roller as set forth in claim 16, wherein the amount of applied primer per unit area is 0.006 g/cm2 or more.

18. The fixing roller as set forth in claim 16, wherein the primer is resin primer.

19. The fixing roller as set forth in claim 16, wherein an etching treatment is performed on a surface of the resin layer that faces the elastic layer, the etching treatment being such that liquid ammonia containing dissolved metallic sodium is used as a treatment solution.

20. The fixing roller as set forth in claim 16, wherein an etching treatment in which excimer laser is irradiated is performed on a surface of the resin layer that faces the elastic layer.

21. A method for evaluating a fixing roller that is included in a fixing apparatus of an image forming apparatus and that includes: a core; an elastic layer made of an elastic material, formed around the core; and a resin layer made of fluorine resin, formed around the elastic layer, said method comprising the step of evaluating the fixing roller as passable if the fixing roller meets the following conditions:

the resin layer has a thickness of 40 μm or more;

a peripheral velocity of the fixing roller is set to be 300 mm/s or more in the fixing apparatus; and the fixing roller meets a relation Tr≧Tc+60 where Tr (° C.) is a limit temperature obtained in a detachment test and Tc (° C.) is a temperature of the fixing roller at which the fixing apparatus performs a fixing process, the detachment test being performed in such a manner that a part of the fixing roller that includes the elastic layer and the resin layer is cut out as a sample, the sample is heated in contact with a heating material with a temperature X (° C.) while being subjected to application of a load, and it is confirmed whether or not the resin layer is detached from the elastic layer in the sample after heating, the detachment test being performed plural times with different temperatures X (° C.), a detachment test with a highest temperature X (° C.) being selected our of one or more detachment tests in which detachment between the resin layer and the elastic layer is not observed, and the temperature X (° C.) of the selected detachment test being regarded as the limit temperature.

22. A method for evaluating a fixing roller that is included in a fixing apparatus of an image forming apparatus and that includes: a core; an elastic layer made of an elastic material, formed around the core; and a resin layer made of fluorine resin, formed around the elastic layer, said method comprising the step of evaluating the fixing roller as passable if the fixing roller meets the following conditions:

the resin layer has a thickness of 40 μm or more;

a peripheral velocity of the fixing roller is set to be 355 mm/s or more in the fixing apparatus; and the fixing roller meets a relation Tr≧Tc+75 where Tr (° C.) is a limit temperature obtained in a detachment test and Tc (CC) is a temperature of the fixing roller at which the fixing apparatus performs a fixing process, the detachment test being performed in such a manner that a part of the fixing roller that includes the elastic layer and the resin layer is cut out as a sample, the sample is heated in contact with a heating material with a temperature X (° C.) while being subjected to application of a load, and it is confirmed whether or not the resin layer is detached from the elastic layer in the sample after heating, the detachment test being performed plural times with different temperatures X (° C.), a detachment test with a highest temperature X (° C.) being selected our of one or more detachment tests in which detachment between the resin layer and the elastic layer is not observed, and the temperature X (° C.) of the selected detachment test being regarded as the limit temperature.

* * * * *